United States Patent [19]

Arnold

[11] Patent Number: 4,883,406

[45] Date of Patent: Nov. 28, 1989

[54] TRANSPORT VENTILATOR

[76] Inventor: Johann Arnold, Mühlemattweg 3, CH-6374 Buochs, Switzerland

[21] Appl. No.: 279,154

[22] PCT Filed: Feb. 16, 1988

[86] PCT No.: PCT/CH88/00037

§ 371 Date: Oct. 14, 1988

§ 102(e) Date: Oct. 14, 1988

[87] PCT Pub. No.: WO88/06240

PCT Pub. Date: Aug. 25, 1988

[30] Foreign Application Priority Data

Feb. 17, 1987 [CH] Switzerland ..... 582/87

[51] Int. Cl.[4] ..... F04D 29/52

[52] U.S. Cl. ..... 415/183; 239/654; 198/642; 406/100; 222/410

[58] Field of Search ..... 415/183, 185, 213 B, 415/122 R, 142, 209; 414/301, 162, 211, 158; 239/689, 654, 224; 198/642; 406/96, 99, 100, 151, 181, 195; 222/630, 410, 411

[56] References Cited

U.S. PATENT DOCUMENTS

| | | | |
|---|---|---|---|
| Re. 6,086 | 10/1874 | Bantz | 415/183 |
| 139,854 | 6/1873 | Bantz | 415/183 |
| 1,566,493 | 12/1925 | McKay | 414/143.1 |
| 2,242,278 | 5/1941 | Yonkers, Jr. | 415/121 G |
| 2,513,466 | 7/1950 | Fleming | 406/100 |
| 2,847,156 | 8/1958 | Bleier | 415/215 |
| 3,298,748 | 1/1967 | Hultgren | 414/301 |
| 3,312,386 | 4/1967 | Hull et al. | 415/182 |
| 4,199,108 | 4/1980 | Baumgartner et al. | 239/224 |
| 4,255,082 | 3/1981 | Goebel | 415/182 |
| 4,795,095 | 1/1989 | Shepard | 239/224 |

FOREIGN PATENT DOCUMENTS

| | | | |
|---|---|---|---|
| 65414 | 10/1942 | Norway | 415/182 |
| 676207 | 7/1979 | U.S.S.R. | 239/654 |
| 880305 | 11/1981 | U.S.S.R. | 239/654 |
| 781348 | 8/1957 | United Kingdom . | |
| 2168330 | 6/1986 | United Kingdom . | |

*Primary Examiner*—Robert E. Garrett
*Assistant Examiner*—John T. Kwon
*Attorney, Agent, or Firm*—Thomas W. Speckman; Douglas H. Pauley

[57] ABSTRACT

The present invention provides a fan for moving air or transporting loose material. The fan comprises an inlet suction pipe that is bifurcated to form two pieces that then open out into a cone, after which there is a fan-blade wheel. This fan-blade wheel is driven by a drive shaft that passes through the cone and out in the area between the pipes. The drive shaft is driven directly by a motor or through a belt or gear-train drive system.

5 Claims, 4 Drawing Sheets

TRANSPORT VENTILATOR

BACKGROUND OF THE INVENTION

1. Field of the Invention

The present invention relates to a fan for moving air or for transporting loose material.

2. Description of the Prior Art

The wood-processing industry, in particular, uses fans that suck up the chips, dust and sawdust produced during operations at the workplace and then deliver this debris through separators and into silos. Very often, several such suction evacuation systems are connected to one fan. Before the mixture of air, chips, and/or sawdust is passed through the actual fan, it goes through a separator, within which the larger—and in particular the heavier—particles are removed by gravity.

The present invention relates to a fan for moving air or for transporting loose material, this having a fan-blade wheel, a drive motor, and a suction inlet pipe. Fans of this kind are known. They operate as centrifugal fans, in that the air or mixture that is drawn in enters the fan in an axial direction relative to the axis of the fan blade, is deflected and accelerated radially, and then the air or the loose material that is carried by it is thrown out of the fan in a tangential direction. Such fans have been used for many years, in particular as transport fans used, for example, for hay, as well as in the wood-processing industry. A second disadvantage in such fans is the fact that any possible larger solid particles that are not removed by the separator are accelerated very greatly both radially and tangentially after entering the fan and, as a consequence of this, strike the walls of the outlet pipe like projectiles. Thus, there is a large amount of wear on such material, caused by the abrasive effect of this impact, and in some older plant this even causes deformation of the walls. In the most extreme cases, the walls can even become perforated.

Consideration has also been given to replacing centrifugal fans by other types, such as axial fans. However, such considerations always migrated away from the ideal of using an axial fan. On the other hand, installing a motor in the pipe results in a considerable reduction of cross-section; on the other hand, a motor that is incorporated in this way is always exposed to the impact of solid particles and is thus endangered by such blows. On the other hand, too, such a fan presents a trap for material such that, in the worst case, this can lead to the fan becoming blocked. A further disadvantage of a motor that is incorporated axially in the pipe lies in the fact that it is very inacessible for maintenance and repair operations.

SUMMARY OF THE INVENTION

The present invention provides a fan that operates in the same way as a radial fan and which avoids the disadvantages set out above.

According to the present invention there is provided a fan for moving air or for transporting loose material, having a fan-blade wheel, a drive motor, and an inlet suction pipe, which suction pipe is bifurcated ahead of the fan-blade wheel so as to form two separate pipes that, taken together, are of a cross-sectional area that is at least equal to the cross-sectional area of the inlet-suction pipe, the bifurcated pipes opening into a greater opening of a common cone, the fan-blade wheel being arranged on the outlet side of the cone, and the drive shaft of the fan-blade wheel passing axially outwards in an area between the two bifurcated pipes and being driven by means of the drive motor located outside the pipes.

Thus, according to the present invention the inlet suction pipe is bifurcated ahead of the fan blade wheel so as to form two separate pipes, these two pipes having a cross-section that corresponds at least to the cross-section of the inlet suction pipe before the bifurcation, and wherein the bifurcated pipes open out into the large opening of a common cone, with the fan blade wheel being arranged on the outlet side ahead of the cone, and wherein the drive shaft for the fan-blade wheel extends in an axial direction towards the cone outwards in the area between the two bifurcated pipes and is driven by a motor that is located outside the pipes.

In one embodiment of the present invention the drive motor drives the drive shaft by notched belts that pass around notched-belt pullies.

In another embodiment of the present invention the drive motor drives the drive shaft by mans of V-belts that pass around V-belt pullies. Suitably the fan-blade wheel is closed off on the side remote from the cone by means of a thrower plate, a flange forming a fixed wall for the fan-blade wheel. Desirably the fan-blade wheel is arranged in the interior of a distributor cowl, the loose material that is thrown radially outwards from the fan-blade wheel being deflectable by an inner wall of said cowl.

Thus, the present invention provides a fan that displays only a very slight tendency to become blocked and which is thus extremely easy to service.

BRIEF DESCRIPTION OF THE DRAWINGS

The present invention is described in greater detail below on the basis of the accompanying drawings, in which.

DESCRIPTION OF THE PREFERRED EMBODIMENT

Figure 1:
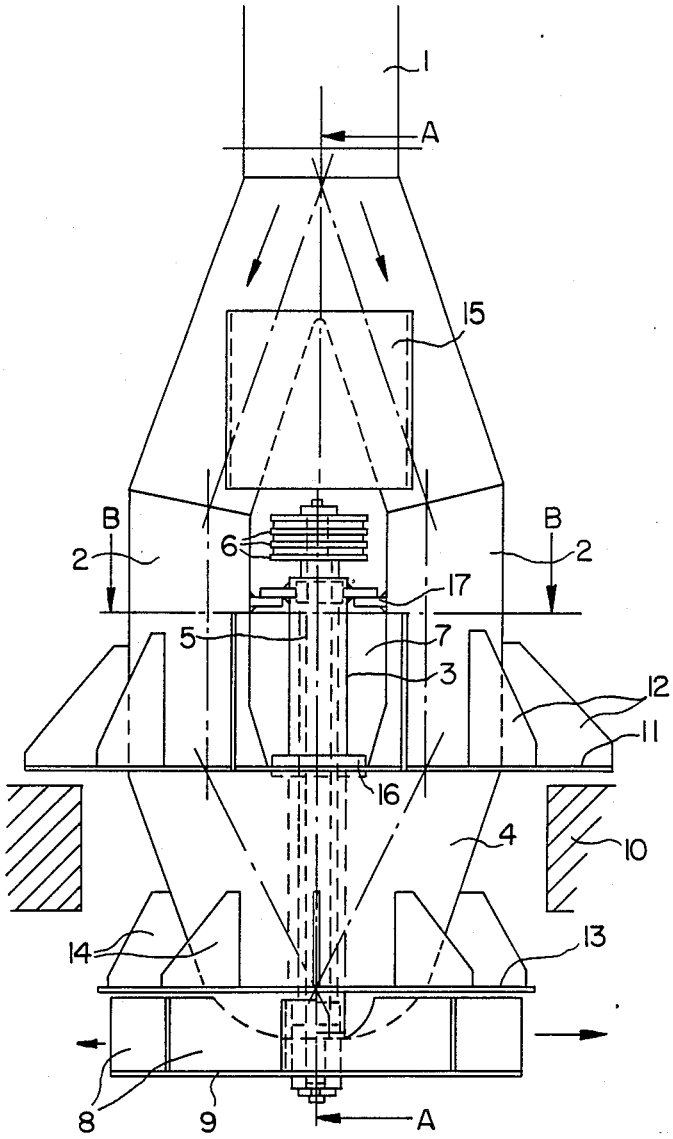
FIG. 1 is an overall view of the fan, in cross-section.

In practice, a fan that is used to move air or transport loose material is understood to comprise a complete system, this including an inlet suction pipe, a fan and its motor, and under certain circumstances, a blast or conveyor pipe.

In the accompanying drawing, the inlet suction pipe, which passes from the inlet(s) into the area of the fan itself is numbered 1. In front of the fan-blade wheel 8 the inlet suction pipe 1 splits into two separated pipes 2. Each pipe forms an arc which can, however, be formed from separate sections of pipe. Immediately in front of the fan-blade wheel 8, these two pipes reunite in that they both open out into the larger opening of a cone 4.

The cone 4 then opens out into the fan housing which can in its turn open out into a blast or feed pipe.

Figure 5:
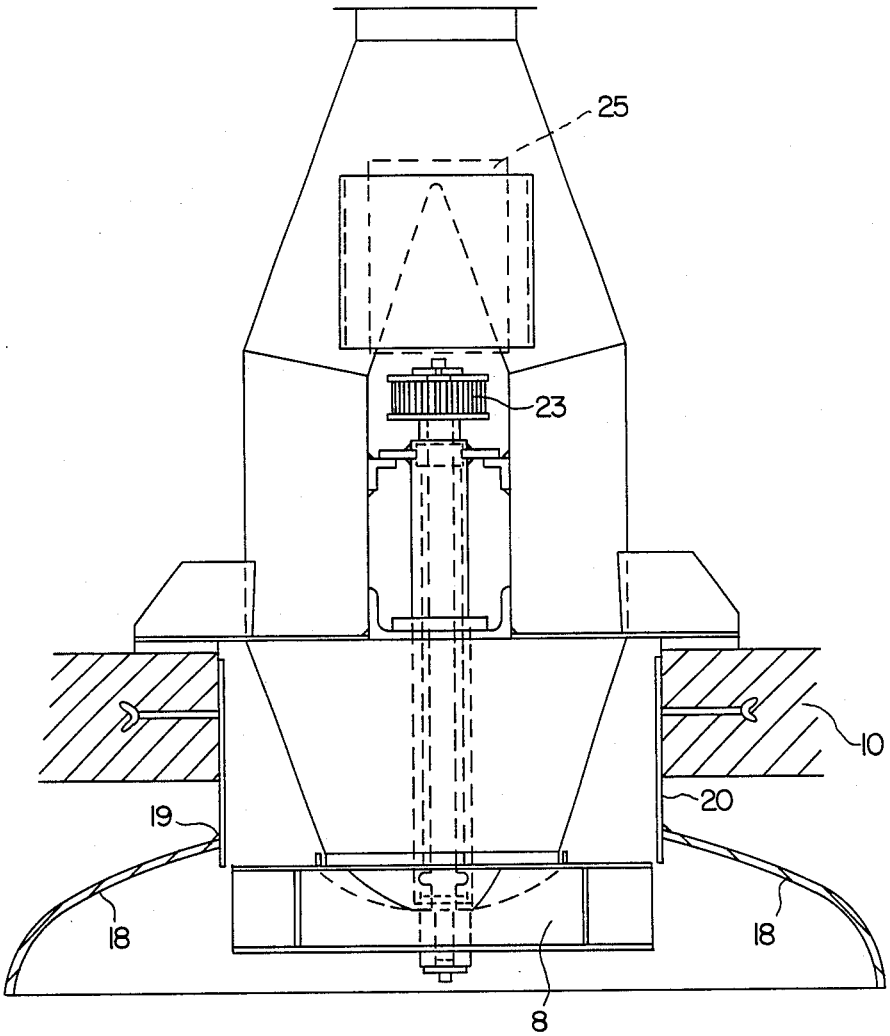
FIG. 5 is a section similar to FIG. 1 of the fan with its associated distributor cowl.

The fan-blade wheel 8 can also be open, which is to say it need not be incorporated in a housing as is shown in FIG. 1. The fan-blade wheel 8 is driven by means of a drive shaft 5 that passes in an axial direction towards the cone, outwards in the area 7 between the two bifurcated pipes 2. The drive shaft 5 passes through the mounting plate 11, within which it is held and supported by means of a bearing pipe 3. At the end, this bearing pipe is once again supported between the two pipes 2 and the shaft 5 is fitted with a pulley for a notched belt 23 or a V-belt 21. The bearing pipe, which can be removed upwardly is also held on the mounting plate 11 by the mountings 16 and 17, or on the two pipes 2. A suitable drive motor 25, that can be installed a short distance from the fan as shown in FIG. 5, drives the shaft 5 through notched belt 23 or V-belts 21. It is also possible to mount drive motor 25 on the mounting plate 11. In another embodiment, drive motor 25 can be installed directly between the two bifurcated pipes 2, from where it drives the drive shaft 5 directly or through a belt or gear drive system. The fan can also have a motor platform 15 above the bifurcation of the inlet suction pipe 1, which is fixed in this position and can support the motor. A fan of this kind is particularly well-suited for moving loose material that has to be introduced into a silo at the top of the structure, for example. The same kind of arrangement that is shown in FIG. 1 can be used advantageously as a transport fan for the disposal of sawdust, planing chips, and similar material produced by wood-processing plants and by the wood-processing industry. For a very long time, silo facilitates have been used for disposal of this kind. Such a silo has a movable intermediate floor 10. The pipe through which the wood waste is moved to the silo passes through this intermediate floor 10 and into the interior of the actual silo. In addition, this intermediate floor has additional openings over each of which filter bags are installed with their opening directed downwards. The bottom of each of these filter bags is suspended on top upward. A further pipe leads from the space above the intermediate floor back into the workshop. The efficient operation of such a disposal system requires only a powerful fan that can ensure the movement of a sufficient quantity of air. In winter, the heated air in the workshop, together with the wood waste, is evacuated and pumped into the interior of the silo. The wood waste remains in the silo, whereas the air that is used as the transporting agent passes through the filter bags and back into the workshop, so that the heat that it contains is not lost. The fan that is shown in FIG. 1 is particularly well-suited for use in a system such as is described above. To this end, it is installed in a vertical system in a cutout made for this purpose in the intermediate floor. It is provided with a mounting plate 11 in the area of the two bifurated pipes 2; this mounting plate is bolted securely to the intermediate floor 10 in which the mounting 16 of the bearing pipe 3 is also installed. There are webs 12 to provide strengthening between the mounting plate 11 and the pipes 2. This ensures that the whole of the fan is solidly installed on the mounting plate 11. In order to prevent vibration being transmitted from the fan to the intermediate floor 10, a special sealing material that absorbs vibrations and oscillations can be installed between the mounting plate 11 and the intermediate floor 10. Beneath the fan, the fan-blade wheel is installed on the drive shaft 5 so as to be exposed. The material that arrives from above after being sucked in by the fan-blade wheel 8 is thrown radially away from the fan axis because of the rotation of the blades 8, so that the silo is filled evenly. There is a flange 13 arranged ahead of the fan-blade wheel 8 in the direction in which the material is moved; this flange forms a fixed fan wall for the fan-blade wheel 8 and is secured to the cone 4 by means of the flange webs 14. This flange also serves as a connector for a possible blast or feed pipe that may be connected to the fan. This is needed, mainly, if the air or loose material is to be moved over an even greater distance.

Figure 2:
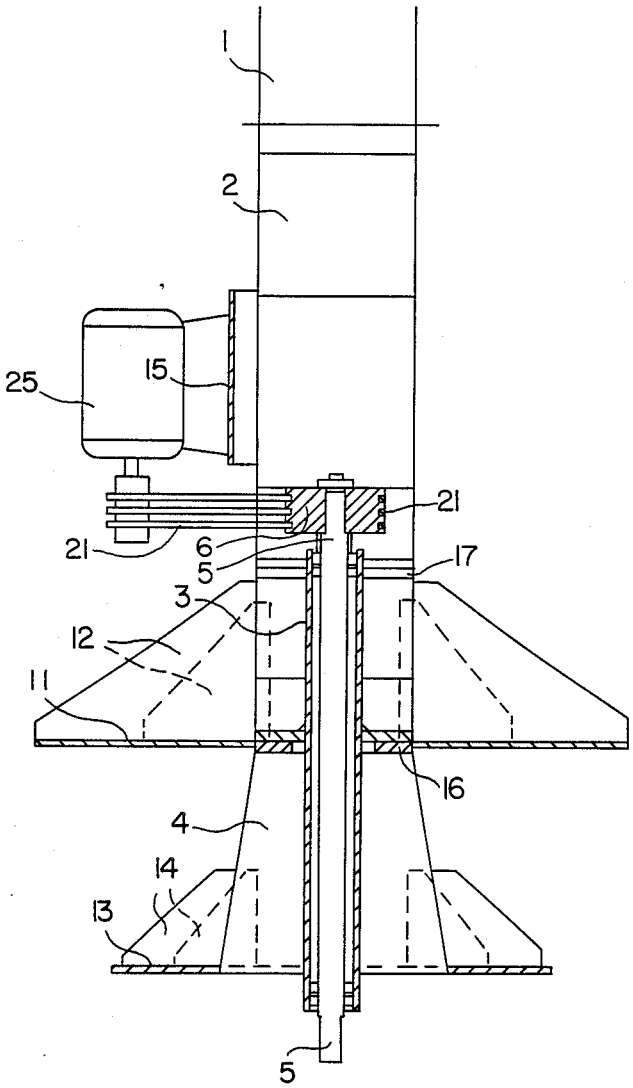
FIG. 2 is a cross-section on the line A—A in FIG. 1.
Figure 3:
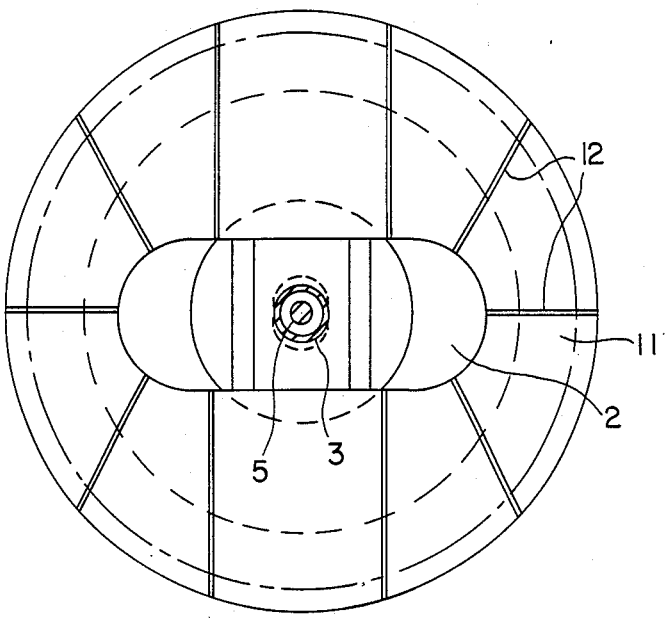
FIG. 3 is a view of the fan as in FIG. 1, from above, and in partial section on the line B—B in FIG. 1.

FIG. 2 is a cross-section of the fan according to the present invention, this cross-section being cut on the line A—A in FIG. 1. It can be seen how the drive shaft 5 is supported within a pipe that, in its turn, is connected with the pipe mounting 16 to the pipes 2. The motor platform 15 can also be seen above the bifurcation of the inlet suction pipe 1. Finally, FIG. 3 shows the fan according to the present invention in a plan view that shows an exemplary arrangement of the webs 12.

Figure 4:
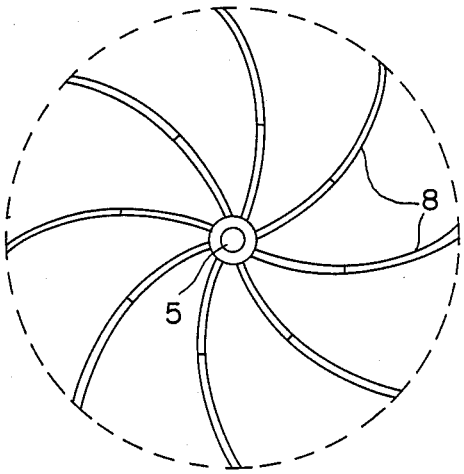
FIG. 4 is a plan view of the fan-blade wheel.

FIG. 4 shows a fan-blade wheel 8 such as can be used in a fan according to the present invention. The fan-blade wheel 8 is covered by a circular plate 9 on the side that is remote from the cone 4, and this acts as a throw plate. The fan according to the present invention can be installed not only vertically, as is shown in FIG. 1, but also horizontally or in an inclined position, especially if it is to be used solely for moving air. Such an application is appropriate, for instance, mainly for the ventilation and evacuation of road tunnels. A fan that incorporates those features that are essential to the present invention will move more air for a given motor power output. Furthermore, the delivery performance that is required with respect to loose material to better than the performance that can be achieved with centrifugal fans. In addition, damage to the housing is impossible, since the material that is moved is not forced to make any abrupt changes in direction. Also, compared to centrifugal fans, there are no buildups of the material or even stoppages caused by the loose material that is being used.

In contrast to centrifugal fans, the particles are evenly distributed in the silo because ejection takes place in all directions around 360 degrees. Thus there is no need for a vortexing device. The fan-blade wheel thus acts simultaneously as a thrower or broadcaster for the solid particles.

If the material that is being moved is made up of light particles, it is advisable to incorporate a distributor cowl 18, as shown in cross-section in FIG. 5. Such a distributor cowl is best installed on the intermediate floor of the silo by means of a pipe 20 that is welded to its upper opening 19. The delivery fan can then be removed independently of the distributor cowl 18 for purposes of repair, maintenance, or replacement. The distributor cowl 18 shields the fan-blade wheel relative to the silo chamber. When the fan-blade wheel 8 is running, the loose material is thrown against the inner wall of the distributor cowl 18. The rotation of the fan-blade wheel also superimposes a circulatory pattern on the air that is being moved, so that the air within the cowl 18 spirals downwards. The solid particles that are being moved are thus moved forcibly downwards. Without such a distributor cowl 18 the loose material would just be moved radially outwards and only fall as a result of gravity. In the case of light, loose material such as sawdust or the like, the density of the dust in the vicinity of the filter would be too great, so that these filters would become clogged in a very short space of time. In contrast to this, when a distributor cowl is used, the loose material is moved forcibly downwards within the silo. The air that is blown downwards is deflected by the surface of the material in the silo, when the particles that this air is supporting are dropped. The air then rises in the outer area of the silo interior, and flows out around the distributor cowl 18 and to the filter bags.

The embodiments of the invention in which an exclusive property or privilege is claimed are defined as follows:

1. A transport ventilator for moving air or for transporting loose material, the transport ventilator comprising: a fan-blade wheel, a drive motor, an inlet suction pipe, said inlet suction pipe bifurcated upstream of said fan-blade wheel forming two separate pipes, said two separate pipes having a first cross-sectional area at least equal to a second cross-sectional area of said inlet suction pipe, said bifurcated pipes discharging into an expanded opening of a common cone, said fan-blade wheel arranged on an outlet side of said cone, a drive shaft of said fan-blade wheel extending axially outwards in an area between said bifurcated pipes, and said drive shaft driven by a drive motor located outside said bifurcated pipes.

2. A transport ventilator according to claim 1, wherein said drive motor drives said drive shaft using notched belts that pass around notched-belt pulleys.

3. A transport ventilator according to claim 1, wherein said drive motor drives said drive shaft using V-belts that pass around V-belt pulleys.

4. A transport ventilator according to claim 1, wherein said fan-blade wheel has a thrower plate closing off a side remote from said cone, and a flange forming a fixed wall for said fan-blade wheel.

5. A transport ventilator according to claim 1, wherein said fan-blade wheel is positioned in an interior of a distributor cowl and an inner wall of said distributor cowl deflects loose material that is thrown radially outwards from said fan-blade wheel.

* * * * *